US008608138B2

(12) United States Patent
Cooke

(10) Patent No.: US 8,608,138 B2
(45) Date of Patent: Dec. 17, 2013

(54) INLINE INFUSION DEVICE AND METHOD FOR INTRODUCTION OF A GAS INTO A FLOWING MEDIA

(75) Inventor: Robert Cecil Cooke, Wendell, NC (US)

(73) Assignee: Fortrans, Inc., Wendell, NC (US)

( * ) Notice: Subject to any disclaimer, the term of this patent is extended or adjusted under 35 U.S.C. 154(b) by 33 days.

(21) Appl. No.: 13/370,358

(22) Filed: Feb. 10, 2012

(65) Prior Publication Data

US 2013/0207285 A1 Aug. 15, 2013

(51) Int. Cl.
*B01F 3/04* (2006.01)

(52) U.S. Cl.
USPC ..... 261/77; 96/243; 366/101

(58) Field of Classification Search
USPC ..... 261/76, 77; 96/243; 55/418; 366/101
See application file for complete search history.

(56) References Cited

U.S. PATENT DOCUMENTS

| | | | | |
|---|---|---|---|---|
| 3,165,562 | A * | 1/1965 | Young et al. | 261/122.1 |
| 4,259,360 | A * | 3/1981 | Venetucci et al. | 426/231 |
| 5,261,452 | A * | 11/1993 | McAndrew et al. | 137/606 |
| 5,376,311 | A | 12/1994 | DeGuzman | |
| 6,103,128 | A | 8/2000 | Koso et al. | |
| 6,767,008 | B2 | 7/2004 | Shane | |

FOREIGN PATENT DOCUMENTS

EP 1151786 A1 11/2001

OTHER PUBLICATIONS

Porous Ceramic Filters, Refraction Technologies, http://www.refraction.com/filtration.asp, Jul. 7, 2011.

* cited by examiner

*Primary Examiner* — Robert A Hopkins
(74) *Attorney, Agent, or Firm* — James G. Passé; Passé Intellectual Property, LLC

(57) ABSTRACT

The present invention comprises a method and system for the infusion of a gas into a liquid. The gas is passed through a container with ceramic filtering material of a specific pore size after which the gas enters the flow stream of the liquid.

20 Claims, 3 Drawing Sheets

INLINE INFUSION DEVICE AND METHOD FOR INTRODUCTION OF A GAS INTO A FLOWING MEDIA

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to a method and system for the infusion of a gas into in a flowing media. In particular, the present invention relates to a diffusion mixing device for the introduction of gas into a media as it flows past the point of introduction.

2. Description of Related Art

The introduction of a gas into a liquid, especially while it is flowing from one point to another, has been the object of many methods and apparatus. The purpose is normally to dissolve one or more gases in a flowable media, such as water or other liquid, or in some cases another gas, as it passes the point of gas introduction. The utility of such processes is widespread, including lowering the pH of the flowing media, increasing levels of beneficial gases in the media, treating media containing pollutants, adding nitrogen, carbon dioxide or oxygen to water, gasoline, and the like treatment of the media. Carbon dioxide, carbonic acid, oxygen, and nitrogen gas are frequently added to water or other liquids for their beneficial uses. Ozone is utilized as a sterilizing agent for waste water, swimming pools, and other areas where traditionally chlorine is used.

A number of different arrangements have been and are still being used to introduce gas into a liquid. In general, they involve a device attached in the stream of media, such as an attachment to a pipe and injecting the gas into the stream. Some methods involve placement of devices in the stream of flowable media to aid in the mixing and dissolution of the gas. Further addition of pressure, increasing flow turbulence, changes of temperature, and the like are all utilized in the introduction process. In some methods gas is bubbled into the media or mechanical aeration devices are utilized. Other methods include sparger stones, diffusers and mixers placed in the stream of the media.

The main issues with the current technology is that there is a huge problem with the fouling of the internal parts of the introduction or mixing devices and frequently flow needs to be slowed or conditions of flow changed sufficiently that it severely increases the cost of the introduction. Further, there is still much inefficiency in the process and frequently the introduction is incomplete. Even further, where there is a multiplicity of gases to be introduced, the problems tend to be compounded and the system is even less efficient.

BRIEF SUMMARY OF THE INVENTION

The present invention relates to the discovery that if gases are passed into a pressurized chamber and optionally through a diffusion media within the chamber before entering into the flow of a media in a pipe, then the above problems with gas introduction into a flowable media are largely avoided.

Accordingly, one embodiment of the present invention is a system for the introduction of one or more gases into a flowable media comprising:

a) a pipe containing a flowing media;

b) a gas infusion device comprising a containment enclosure pressurized to at least 5 psi and optionally enclosing a porous diffusion material having a pore size of from about 5 microns to about 90 microns; an inlet for introducing the one or more gases into the enclosure; an outlet in communication with the flowing media; wherein the optional diffusion material is positioned such that the gas passes through the diffusion material and into the flowing media; and c) a gas source for introducing the one or more gas into the inlet.

In another embodiment the present invention comprises a gas infusion device for the introduction of one or more gases into a flowable media comprising:

a) a containment enclosure pressurized to at least 5 psi and optionally enclosing a porous diffusion material;

b) an inlet for introducing the gas into the infusion device;

c) an outlet for delivering the gas to the flowable media; and wherein the optional ceramic cylinder is positioned such that gas introduced into the device passes through the diffusion material before it can exit the outlet.

In yet another embodiment of the invention there is a method for the introduction of one or more gases into a flowable media flowing in a pipe comprising:

a) selecting a gas infusion device comprising a containment enclosure pressurized to at least 5 psi and optionally enclosing a porous diffusion material having a pore size of from about 5 microns to about 90 microns; an inlet for introducing the one or more gases into the enclosure; an outlet for attaching the infusion device into the media flowing in the pipe wherein the diffusion media is positioned such that the gas passes through the diffusion material;

b) positioning the outlet in fluid communication with the flowable media in the pipe;

c) attaching a gas source to the inlet of the infusion device; and d) passing the gas from the gas source, through the infusion device and into the flowable media.

DETAILED DESCRIPTION OF THE INVENTION

Figure 1:
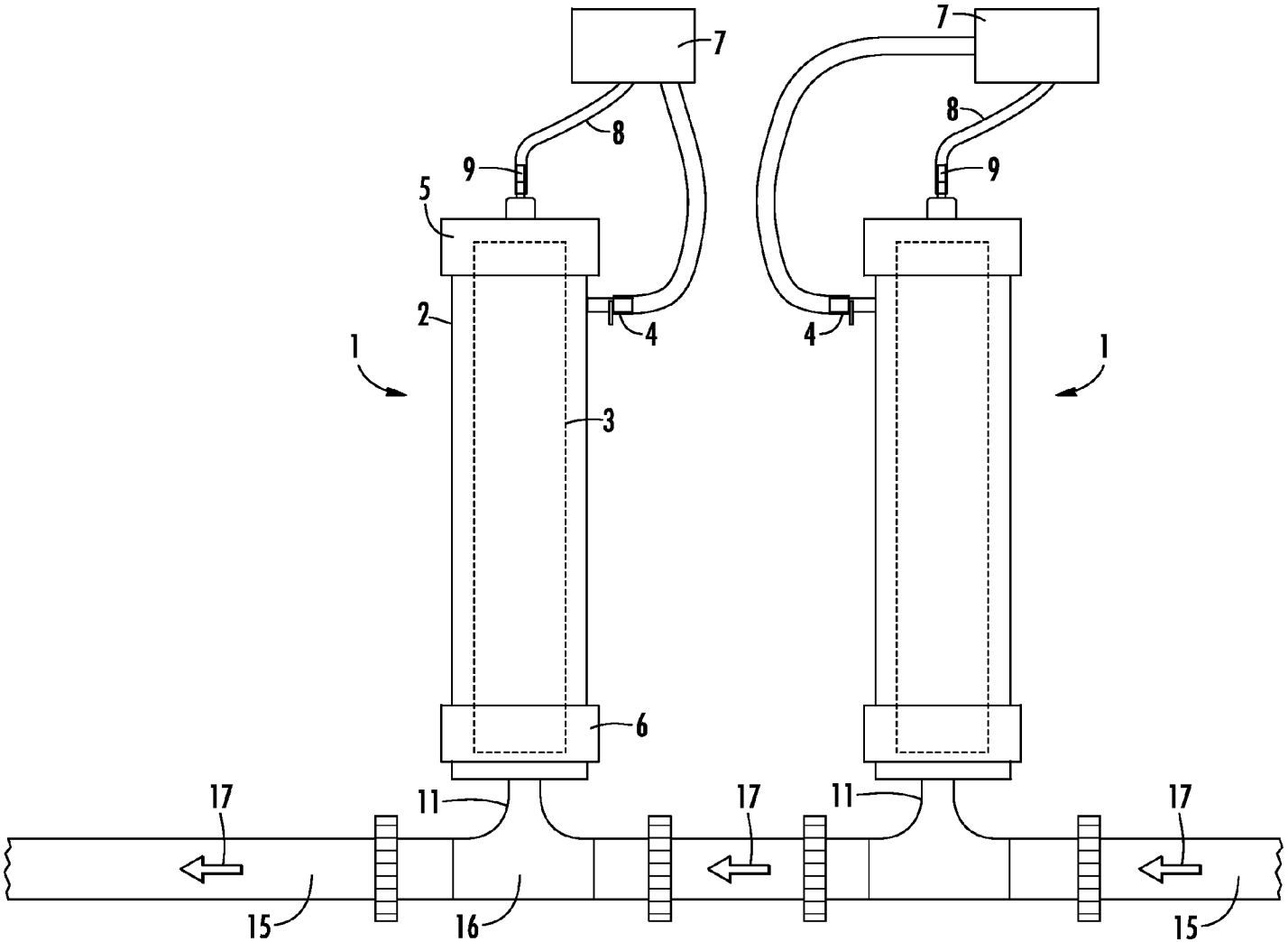
FIG. 1 is a side view of an embodiment of the present invention showing the system with two optional diffusion materials engaging a pipe.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "about" and "essentially" mean ±10%.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the terms "flowable media" and "flowing media" refer to one or more gases or liquids that are flowing through a transport pipe. Liquids such as water, gasoline, diesel fuel, natural gas, or any other liquid or gas chemicals are included in the term "flowable media". The term assumes that the temperature and pressure conditions of the media within the pipe are such that the media is flowing from one point in the pipe to another point. The term "pipe" is given the normal meaning and the pipe is chosen to be suitable to transport the selected media being transported within. Therefore, glass, metal, plastic, or the like can be chosen for the liquid and one skilled in the art can choose a pipe compatible with the media.

As used herein a "gas infusion device" refers to a device that is capable of introducing one or more gases into a flowable media stream optionally passed through a diffusing material. The one or more gases can remove or combine with selected components contained in the flowable media and serve to purify or isolate undesirable components in the flowable media. In the present invention, it comprises a novel set of components. The gas infusion device of the present invention comprises a "containment enclosure" such as a cylinder which can contain or pass through the gas being diffused into the flowing media. A cylinder enclosure with a cap that is sealed from the atmosphere other than the gas inlet and outlet of the device is a contemplated embodiment. One could, for example, take an open cylinder or pipe and cap both ends or weld them shut as desired. The containment enclosure can be materials such as a metal (like stainless steel), plastic, glass, or the like compatible with the gas, pressure, and conditions of the process and one skilled in the art can select such materials in view of the disclosure herein and the selected one or more gases. The enclosure is pressurized to at least 5 psi, and in one embodiment between about 15 and 40 psi. In another embodiment the device is pressurized to over 40 psi.

Inside the enclosure is an optional "porous diffusion material". The porous diffusion material is made of porous diffusion filter materials. The filter material should be rigid and have a pore size from about 0.25 microns to 90 microns, 5 microns to 90 microns, 10 microns to 50 microns, or 10 microns to 25 microns. While the diffusion filter material can be any shape (such as cylindric, disk, etc.), generally they are made of solid rigid materials such as metals and ceramics, such as aluminum oxide, silicon carbide, or both and the like in a variety of porous sizes, but in general from about 0.25 to about 90 microns. The pore size will depend on the solubility curve of the gas or gases into the liquid. The less soluble the gas in the liquid, the smaller the pore size is utilized. A second gas can be introduced to facilitate the method. One embodiment is essentially a piece of tube with a diameter from about two inches to about five inches and from about two inches to about forty-eight inches long, but relatively any size can be used with a porous diffuser filter material.

The present invention containment enclosure has an inlet and outlet for introduction of the gas and removal of the gas for an introduction into the flow of the media. For example, any convenient method could be utilized. Standard gas connectors could be used for attaching gas hoses and the like to the containment cylinder. Once again, a hose type connection can be used for connecting the pipe, or as shown in the drawing, an inline outlet is utilized.

The gas source utilized in the present invention is from any normal source. In some embodiments it is carbon dioxide, oxygen, or the like. A gas tank, a gas generating mechanism, or the like is anticipated. In one embodiment, a plurality of gases is added either through separate gas inlets or through a mixing device prior to the infusion device. In one embodiment, a novel mixing device includes a T shaped mixing chamber wherein each gas is introduced from a side of the T for mixing in the chamber. Mixing is accomplished by the intermixing flow of the gases as they move into and then out of the mixing chamber. The mixing chamber has an outlet which delivers the mixed gas to the infusion device. Note, in one embodiment of the present invention there can be a plurality of infusion devices for infusing the same or multiple gases.

The method of the present invention comprises attaching the gas infusion device outlet to the pipe with the flowable media. A source of one or more gases is attached to the infusion device inlet(s). Once the media is flowing in the pipe, the gas is introduced into the infusion device flowing through the device and optionally flowing through the porous diffusion material. From there it flows out the gas infusion device into the pipe mixing with the flowing media.

Now referring to the drawings, FIG. 1 is a side view of a gas infusion device of the present invention. Gas infusion device 1, consists of containment enclosure cylinder 2 which encloses an optional porous ceramic cylinder 3. In one embodiment the porous ceramic cylinder is not there. As noted above, the porous ceramic cylinder 3 can be a shape such that in one embodiment it includes any shape where the gas passes through the ceramic cylinder 3. The ceramic cylinder 3 is inside the outer cylinder 2 as shown by the dotted line. The containment cylinder 2 is an enclosed structure by means of top cap 5 and bottom cap 6. Gas is provided to the device via gas containers 7 and gas tubes 8. The containment cylinder 2 has inlets 9 such as a gas tube connection as shown, but any inlet means is contemplated. A gas flushing hose with valve 4 can be used to exhaust, purge, flush and/or gas or other undesirable components from the gas/system before, during, or after operation of the system to flush as desired is shown in this embodiment. Finally, gas exits the device 1 via outlet 11 which is attached to the bottom cap 6 in this embodiment and is attached to tube 15 via tube connector 16 feeding the gas into media flow 17. One skilled in the art can substitute designs other than this particular embodiment in view of the disclosure and use herein.

Figure 2:
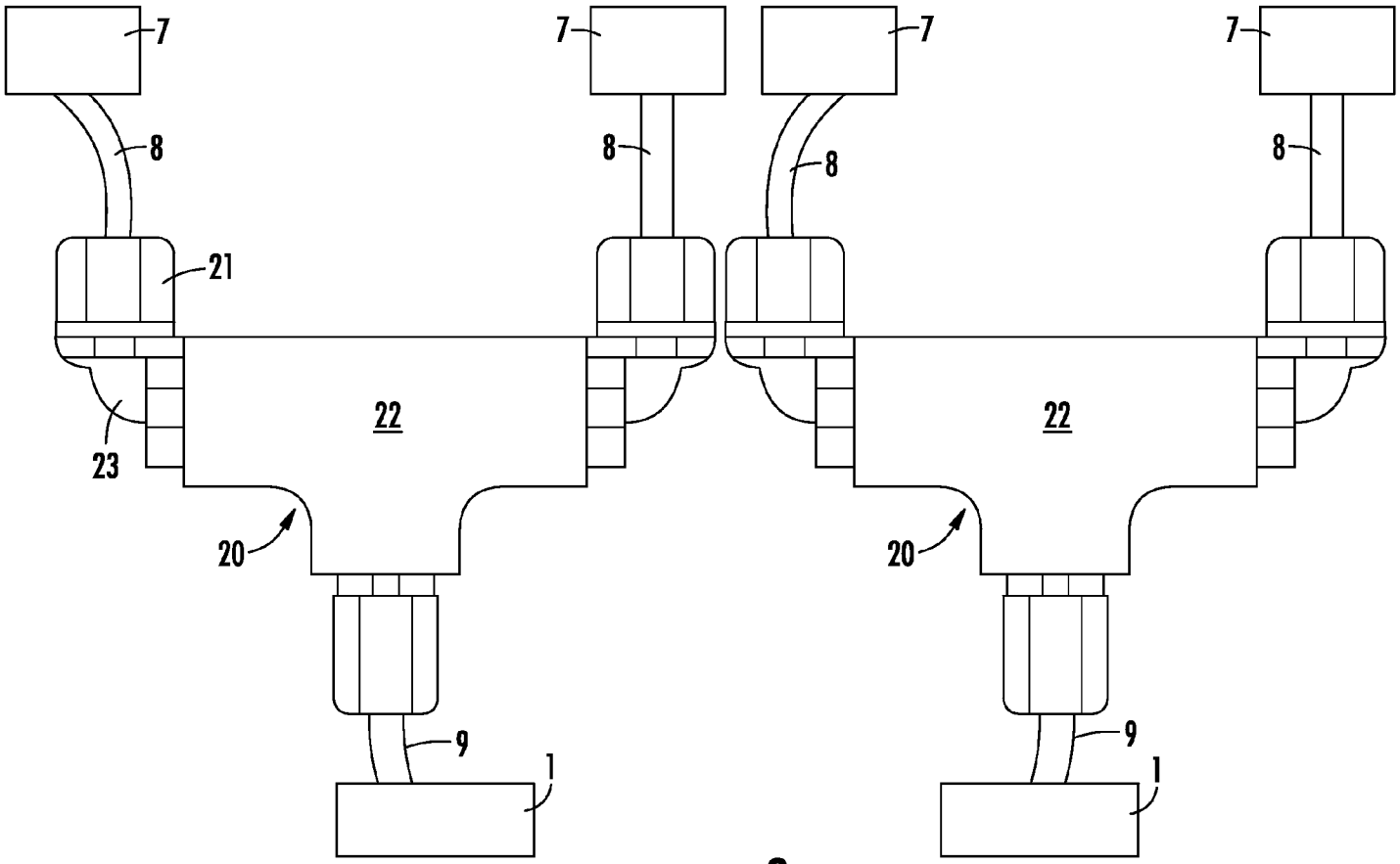
FIG. 2 is a cutaway side view of a gas mixing chamber of the present invention.

FIG. 2 is a cut away side view of a gas mixing device for introducing two or more gases in to the inlet 9 of device 1. The mixing device 20 consists of gas inlet 21 which feeds into T shaped mixing chamber 22 via side inputs 23. As noted in this example, two gases are mixed in the chamber (shown in a cut away version) though any number of gas inputs can be utilized and are only limited by the size of the device. For example, oxygen and carbon dioxide can be combined which in this embodiment would form carbonic acid, thus introducing carbonic acid into a media stream.

Figure 3:
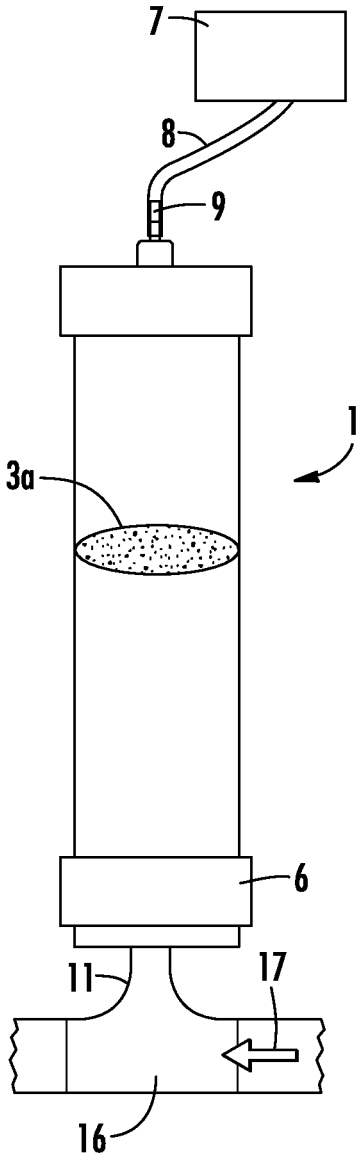
FIG. 3 is a cutaway side view of an alternate arrangement of a gas dispersing device.

FIG. 3 is a cutaway side view of an alternate embodiment of the optional diffusion material. In this embodiment, the diffusion material is a disk 3*a*. The disk material, in one embodiment, is a ceramic or metal disk could be utilized or in one option, not utilized.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A system for the introduction of one or more gases into a flowable media comprising:

a) a pipe containing a flowing media;

b) a gas infusion device positioned outside the pipe comprising a containment enclosure pressurized to at least 5 psi; an inlet for introducing the one or more gases into the enclosure; and a bottom cap;

c) an outlet, the outlet attached to the bottom cap and in fluid communication with the pipe and the containment enclosure; and d) a gas source for introducing the one or more gases into the inlet.

2. The system according to claim 1 wherein the flowing media is water.

3. The system according to claim 1 wherein there are a plurality of gasses introduced into the infusion device.

4. The system according to claim 3 wherein the system further comprises a device for mixing the gases prior to introduction into the infusion device comprising a T shaped mixing chamber wherein each gas is introduced from a side of the T for mixing in the chamber.

5. The system according to claim 4 wherein carbon dioxide and oxygen are introduced into the mixing chamber.

6. The system according to claim 1 wherein enclosed in the containment enclosure is a porous diffusion material having a pore size of from about 5 microns to about 90 microns wherein the diffusion material is positioned such that the gas passes through the diffusion material and into the flowing media.

7. The system according to claim 6 wherein the pore size is from about 10 microns to about 50 microns.

8. The system according to claim 1 wherein a rate the gas is introduced into the media is computer controlled.

9. The system according to claim 6 wherein the diffusion material is porous ceramic material.

10. The system according to claim 6 wherein the diffusion material is hollow on an inside portion and the gas is introduced into the hollow portion and passes through the material to an area outside the diffuser material to the flowing media.

11. The system according to claim 6 wherein the diffusion material is cylindrical and gas passes from inside the cylinder to outside the cylinder.

12. A gas infusion device for the introduction of one or more gases into a flowable media contained in a pipe the device designed to be positioned outside the pipe comprising:

a) a containment enclosure pressurized to at least 5 psi;

b) an inlet for introducing the gas into the infusion device; and c) an outlet for delivering the gas between the containment enclosure and the flowable media in the pipe.

13. The gas infusion device according to claim 12 wherein the containment enclosure enclosing a porous diffusion material wherein the diffusion material is positioned such that gas introduced into the device passes through the diffusion material before it can exit the outlet.

14. A method for the introduction of one or more gases into a flowable media flowing in a pipe comprising:

a) selecting a gas infusion device positioned outside the pipe comprising a containment enclosure pressurized to at least 5 psi; an inlet for introducing the one or more gases into the enclosure; and a bottom further comprising an outlet positioned between the gas infusion device and the pipe for attaching the infusion device in fluid communication with the media flowing in the pipe;

b) positioning the outlet in fluid communication with the flowable media in the pipe;

c) attaching a gas source to the inlet of the infusion device; and d) passing the gas from the gas source, through the infusion device and into the flowable media.

15. The method according to claim 14 wherein there are a plurality of infusion devices infusing a gas into the flowable media.

16. The method according to claim 14 wherein the flowable media is water, gasoline, diesel fuel, or natural gas.

17. The method according to claim 14 wherein the method further comprises selecting a device for mixing the gases prior to introduction into the infusion device comprising a T shaped mixing chamber wherein each gas is introduced from a side of the T for mixing in the chamber and attaching the mixing device to the inlet of the infusion device.

18. The method according to claim 16 wherein carbon dioxide and oxygen are introduced into the mixing chamber.

19. The method according to claim 14 wherein the containment enclosure is enclosing a porous diffusion material having a pore size of from about 5 microns to about 90 microns wherein the diffusion media is positioned such that the gas passes through the diffusion material.

20. The method according to claim 12 wherein the diffusion material is a ceramic material.

* * * * *